US011975253B2

(12) United States Patent
Jourdeans

(10) Patent No.: US 11,975,253 B2
(45) Date of Patent: May 7, 2024

(54) BASKETBALL TRAINING DEVICE AND METHOD

(71) Applicant: RULE OF 5 ENTERPRISES, LLC, Roberts, WI (US)

(72) Inventor: Duane Frederick Jourdeans, Roberts, WI (US)

(73) Assignee: Rule of 5 Enterprises, LLC, Roberts, WI (US)

( * ) Notice: Subject to any disclaimer, the term of this patent is extended or adjusted under 35 U.S.C. 154(b) by 1950 days.

(21) Appl. No.: 14/340,116

(22) Filed: Jul. 24, 2014

(65) Prior Publication Data

US 2015/0038271 A1 Feb. 5, 2015

Related U.S. Application Data

(60) Provisional application No. 61/860,756, filed on Jul. 31, 2013.

(51) Int. Cl.
*A63B 69/00* (2006.01)
*A63B 71/02* (2006.01)

(52) U.S. Cl.
CPC .... *A63B 69/0071* (2013.01); *A63B 2071/026* (2013.01); *A63B 2210/50* (2013.01); *A63B 2243/0037* (2013.01)

(58) Field of Classification Search
CPC ... A63B 63/00; A63B 69/0071; A63B 21/026; A63B 69/0002; A63B 63/003; A63B 69/38; A63B 69/34; A63B 2071/026; A63B 2210/50; A63B 2243/0037
USPC ..... 473/447, 448, 422, 451, 453, 454, 461; D21/783
See application file for complete search history.

(56) References Cited

U.S. PATENT DOCUMENTS

D181,633 S * 12/1957 de la Fariest ..... D21/718
3,532,874 A * 10/1970 Rosenast ..... A47G 33/06 362/123
3,552,749 A * 1/1971 Piggotte ..... A63B 69/0071 473/448
3,609,343 A * 9/1971 Howlett ..... A01K 63/06 119/256
3,624,385 A * 11/1971 Wall ..... A47G 33/0836 362/122
3,641,335 A * 2/1972 Wall ..... H01J 61/548 362/123
3,766,374 A * 10/1973 Fairchild ..... F21S 6/002 362/123

(Continued)

OTHER PUBLICATIONS

1. ACP-Marking Whiskers; 2. Markwort—Yellow Base Plugs With Orange Bristles; 3. Champion Sports Black Rubber Anchor Plug with stem and Rope; 4. Schutt:Base Plug—Square; 5. Stadiumpro Grass marking Tufts/Carrots; 6. Anchor Plugs; 7. Pawise-training Equipment (Miscellaneous base with whiskers) (Year: 2000+).*

(Continued)

*Primary Examiner* — Mitra Aryanpour
(74) *Attorney, Agent, or Firm* — Merchant & Gould P.C.

(57) ABSTRACT

A basketball training device that is usable trains basketball players to sweep the ball low when dribbling against and opposing player or protect the ball if they are being defended by an opposing player with high hands is disclosed. The training device includes a base with a friction surface to engage the gym floor. Upright fibers are able to bend upon contact with a ball and regain their original position.

6 Claims, 5 Drawing Sheets

(56) References Cited

U.S. PATENT DOCUMENTS 3,878,503 A * 4/1975 Martin ..... G02B 6/0005 362/123
4,034,215 A * 7/1977 Hashimoto ..... F21S 10/005 362/552
5,045,091 A * 9/1991 Abrahamson ..... A46B 7/04 15/183
5,348,291 A * 9/1994 Scully ..... A63B 63/00 473/454
5,485,993 A * 1/1996 Lipsett ..... A63B 69/0071 473/448
5,501,170 A * 3/1996 Walsh ..... G09F 17/00 116/173
D369,845 S * 5/1996 Knez ..... D21/718
D370,242 S * 5/1996 Bright ..... D21/781
5,683,762 A 11/1997 Banschick
5,800,291 A * 9/1998 Grover ..... A63B 69/0071 473/422
5,819,354 A * 10/1998 Alonso ..... A46B 13/02 15/104.05
5,839,149 A * 11/1998 Scheier ..... A46B 5/0029 15/167.1
5,890,985 A * 4/1999 Jenney ..... A63B 69/0071 473/447
6,053,822 A * 4/2000 Kolodney ..... A63B 57/10 473/387
6,142,882 A * 11/2000 Anglea ..... A63B 69/0013 116/209
6,161,328 A * 12/2000 Sing ..... A01M 3/02 15/160
6,645,094 B2 * 11/2003 Obidiegwu ..... A63B 69/38 473/461
6,665,902 B1 * 12/2003 Vegter ..... A46B 3/20 15/183
D491,619 S * 6/2004 Crouse ..... D21/718
6,832,575 B2 * 12/2004 Carroll, Jr. ..... G01C 15/02 116/209
7,073,932 B2 7/2006 Wainwright
D556,934 S * 12/2007 Sanoner ..... D26/27
7,427,244 B1 * 9/2008 Patel ..... A63B 69/0071 473/447
D604,375 S * 11/2009 Steinhobel ..... D21/717
7,736,247 B2 * 6/2010 Caruso ..... A63B 69/002 473/422
7,828,677 B2 * 11/2010 Steinhobel ..... A63B 57/10 473/387
7,955,196 B2 * 6/2011 Constant ..... A63B 69/0002 473/422
8,113,968 B2 * 2/2012 Fittler ..... A63B 63/003 473/422
D679,428 S * 4/2013 Bonang ..... D26/27
8,517,865 B2 * 8/2013 Schumann ..... A63B 69/0002 473/422
8,858,369 B2 * 10/2014 Murphy ..... A63B 69/0002 473/417
8,992,348 B2 * 3/2015 Meier ..... A63B 69/0002 473/417
2003/0220177 A1 * 11/2003 Orlando ..... A63B 21/04 482/148
2004/0190284 A1 9/2004 Yang
2005/0015905 A1 * 1/2005 Boyer ..... A46B 3/06 15/159.1
2005/0070378 A1 * 3/2005 Parks ..... A63B 57/10 473/387
2006/0089212 A1 * 4/2006 Marchel ..... A63B 21/026 473/422
2006/0205537 A1 * 9/2006 Kiah ..... A63B 57/10 473/387
2007/0004539 A1 * 1/2007 Meichner ..... A63B 63/00 473/447
2007/0194186 A1 * 8/2007 Mars ..... A47B 91/04 248/206.2
2007/0275793 A1 * 11/2007 Liao ..... A63B 69/0002 473/417
2009/0260171 A1 * 10/2009 Sajakorpi ..... A46B 3/08 15/180
2014/0321152 A1 * 10/2014 Cayton ..... G02B 6/0005 362/555
2015/0038271 A1 * 2/2015 Jourdeans ..... A63B 69/0071 473/447

OTHER PUBLICATIONS

Miscellaneous Base with Whiskers (2000+).*
13" Black Fiber Optic Lamp—Home Decor Date First Available Jan. 27, 2010.*
Exhibit 1: "Plyo-Blast *New Item*," http:www.strikersportsllc.com/?product=plyo-blast-new-item.html, 3 pages (admitted as prior art as of Jul. 31, 2013).
Exhibit 2: Figure of "Ply-Blast *New Item*" shown in Exhibit 1, http://strikersportsllc.com/wp-content/uploads/2012/06/action5.jpg, 2 pages (admitted as prior art as of Jul. 31, 2013).
Exhibit 3: Figure of "Ply-Blast *New Item*" shown in Exhibit 1, http://strikersportsllc.com/wp-content/uploads/2012/06/3-units-product-shot.jpg, 1 page (admitted as prior art as of Jul. 31, 2013).
Exhibit 4: Figure of "Ply-Blast *New Item*" shown in Exhibit 1, http://strikersportsllc.com/wp-content/uploads/2012/06/007.jpg, 1 page (admitted as prior art as of Jul. 31, 2013).
Exhibit 5: Figure of "Ply-Blast *New Item*" shown in Exhibit 1, http://strikersportsllc.com/wp-content/uploads/2012/06/0061.jpg, 1 page (admitted as prior art as of Jul. 31, 2013).
Exhibit 6: "Agility Hurdle Set, PLYOHRSET," http://www.bizchair.com/plyohrset-chs.html?utm_source=google.com&utm_medium=Co, 3 pages (admitted as prior art as of Jul. 31, 2013).
Exhibit 7: Figure of "Agility Hurdle Set, PLYOHRSET," http://ep.yimg.com/ay/bizchair1/agility-hurdle-set-plyohrset-fs-chs-7.jpg, 1 page (admitted as prior art as of Jul. 31, 2013).
Exhibit 8: "Dribble Stick Basketball Dribbling & Agility Trainer," http://shop.sklz.com/skill-trainers/dribble-stick/invt/drbstx000, 13 pages (admitted as prior art as of Jul. 31, 2013).
Exhibit 9: "Dribble Stick Basketball Dribbling & Agility Trainer," http://shop.sklz.com/skill-trainers/dribble-stick/invt/drbstx000, 13 pages (admitted as prior art as of Jul. 31, 2013).
Exhibit 10: "Dribble Stick Basketball Dribbling & Agility Trainer," http://shop.sklz.com/skill-trainers/dribble-stick/invt/drbstx000, 13 pages (admitted as prior art as of Jul. 31, 2013).
Exhibit 11: "Dribble Stick Basketball Dribbling & Agility Trainer," http://shop.sklz.com/skill-trainers/dribble-stick/invt/drbstx000, 13 pages (admitted as prior art as of Jul. 31, 2013).
Exhibit 12: "Dribble Stick Basketball Dribbling & Agility Trainer," http://shop.sklz.com/skill-trainers/dribble-stick/invt/drbstx000, 13 pages (admitted as prior art as of Jul. 31, 2013).
Exhibit 13: "Dribble Stick Basketball Dribbling & Agility Trainer," http://shop.sklz.com/skill-trainers/dribble-stick/invt/drbstx000, 13 pages (admitted as prior art as of Jul. 31, 2013).
Exhibit 14: "Dribble Stick Basketball Dribbling & Agility Trainer," http://shop.sklz.com/skill-trainers/dribble-stick/invt/drbstx000, 13 pages (admitted as prior art as of Jul. 31, 2013).
Exhibit 15: "i. Trek Portable Mini Friction Mount for Garmin Nuvi," http://www.amazon.com/i-Trek-Portable-Friction-Mount-Garmin/dp/B001THSVTK/ref=sr_1_21?ie=UTF8&qid=1400551923&sr=8-21&keywords=gps+friction%E2%80%A6, 6 pages (admitted as prior art as of Jul. 31, 2013).
Exhibit 16: "i. Trek Portable Mini Friction Mount for Garmin Nuvi," http://www.amazon.com/i-Trek-Portable-Friction-Mount-Garmin/dp/B001THSVTK/ref=sr_1_21?ie=UTF8&qid=1400551923&sr=8-21&keywords=gps+friction%E2%80%A6, 6 pages (admitted as prior art as of Jul. 31, 2013).
Exhibit 17: "i. Trek Portable Mini Friction Mount for Garmin Nuvi," http://www.amazon.com/i-Trek-Portable-Friction-Mount-Garmin/dp/B001THSVTK/ref=sr_1_21?ie=UTF8&qid=1400551923&sr=8-21&keywords=gps+friction%E2%80%A6, 6 pages (admitted as prior art as of Jul. 31, 2013).
Exhibit 18: "i. Trek Portable Mini Friction Mount for Garmin Nuvi," http://www.amazon.com/i-Trek-Portable-Friction-Mount-

(56) References Cited

OTHER PUBLICATIONS

Garmin/dp/B001THSVTK/ref=sr_1_21?ie=UTF8&qid=1400551923 &sr=8-21&keywords=gps+friction%E2%80%A6, 6 pages (admitted as prior art as of Jul. 31, 2013).
Exhibit 19: "i. Trek Portable Mini Friction Mount for Garmin Nuvi," http://www.amazon.com/i-Trek-Portable-Friction-Mount-Garmin/dp/B001THSVTK/ref=sr_1_21?ie=UTF8&qid=1400551923 &sr=8-21&keywords=gps+friction%E2%80%A6, 6 pages (admitted as prior art as of Jul. 31, 2013).
Exhibit 20: "i. Trek Portable Mini Friction Mount for Garmin Nuvi," http://www.amazon.com/i-Trek-Portable-Friction-Mount-Garmin/dp/B001THSVTK/ref=sr_1_21?ie=UTF8&qid=1400551923 &sr=8-21&keywords=gps+friction%E2%80%A6, 6 pages (admitted as prior art as of Jul. 31, 2013).
Exhibit 21: "010-10908-02 Mount, Portable Friction Mount, Garmin GPS Mounts," http://www.amazon.com/Garmin-Mounts/dp/B00JVGNY5M/ref=sr_1_25?ie=UTF8&qid=1400551998&sr=8-25 &keywor%E2%80%A6, 4 pages (admitted as prior art as of Jul. 31, 2013).

* cited by examiner

BASKETBALL TRAINING DEVICE AND METHOD

REFERENCE TO RELATED APPLICATION

This application claims the benefit of U.S. Provisional Application Ser. No. 61/860,756, filed on Jul. 31, 2013, the disclosure of which is incorporated herein by reference in its entirety.

BACKGROUND

Basketball players in a game strive to protect the basketball from opposing players who want to steal the ball, in order to have success while playing the game. One technique for protecting the basketball when the player is stationary or before beginning to dribble is for the player to move the basketball in a sweeping motion where the ball passes close to the ground when being moved by the player from one side of the player's body to the other. Some basketball players do not understand how to sweep the basketball low when playing the game, and therefore must be taught to perform this basketball move or similar moves.

There is a need for basketball training devices and methods to help players and their coaches train for protecting the ball in practice, such as with a sweep move.

SUMMARY

An athletic training device in accordance with one aspect of the invention includes one or more elongated flexible members that generally maintain a linear shape, and a base with a ground engaging lower surface. An upper mounting device of the base holds the one or more elongated flexible members at the respective proximal end or ends. The one or more flexible members extend generally perpendicularly to the lower surface of the base so that when the base is positioned on the ground, the one or more flexible members extend vertically upwardly. The distal end or ends of the flexible member or members are free to move and bend relative to the proximal end or ends if contacted by a person or a basketball.

The training device holds proximal ends of the elongated flexible members rigidly to the base and allows the distal ends to move back and forth after the flexible members are engaged by a hand, arm or a basketball to give the player or coach feedback that the drill or training exercise was done correctly. The training device is positioned so that the flexible members are generally low to the ground to promote a certain activity by the basketball player wherein the ball is swept or moved in a sweeping motion from one side of the player to the opposite side of the player for training purposes.

During use, a basketball player will engage the device while sweeping the basketball from one side of the player's body to an opposite side of the player's body while stationary (not dribbling), or just prior to dribbling, in an effort to protect the ball while attacking the defensive team.

DETAILED DESCRIPTION

Figure 1:
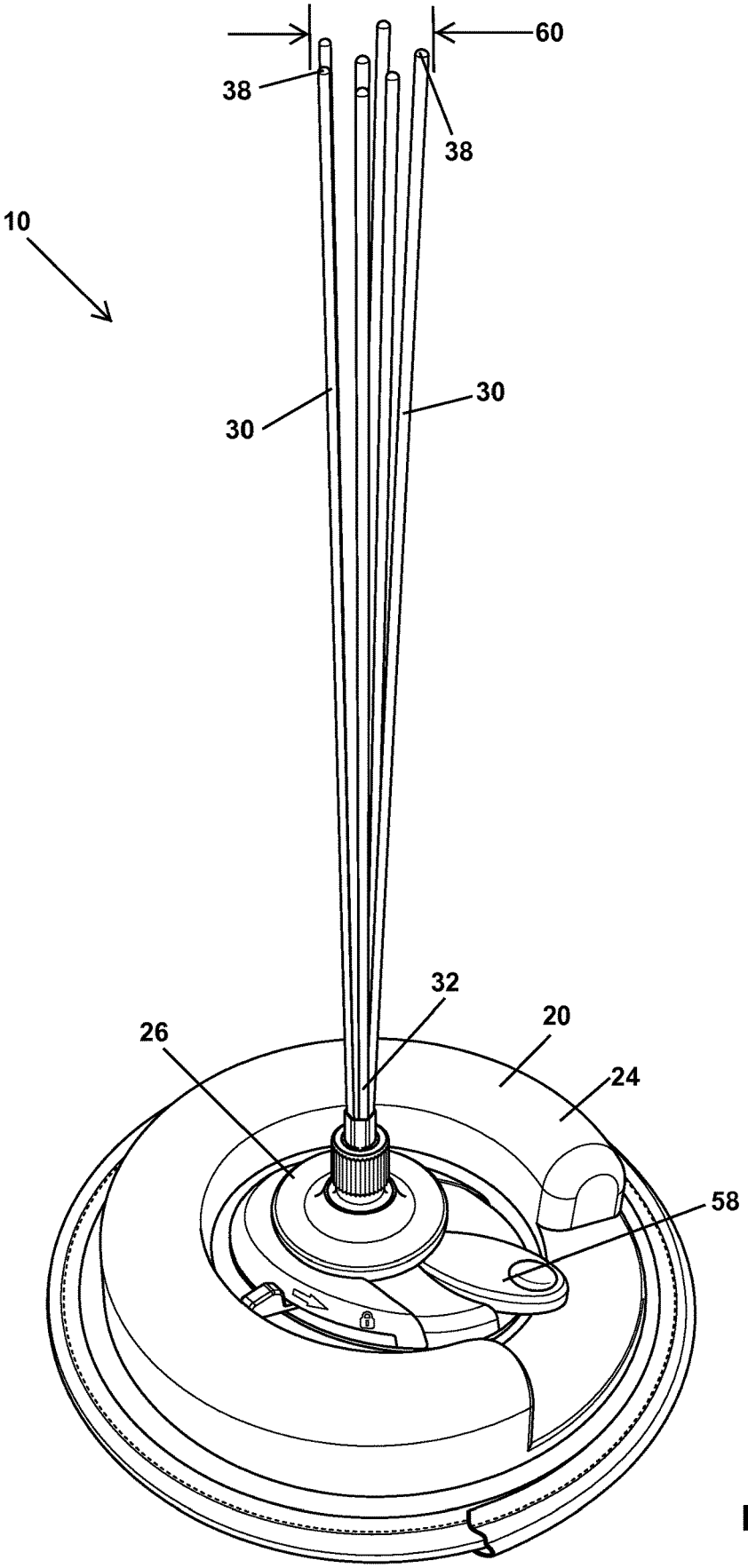
FIG. 1 is a perspective view of one embodiment of a basketball training device including a base and upright flexible members.
Figure 2:
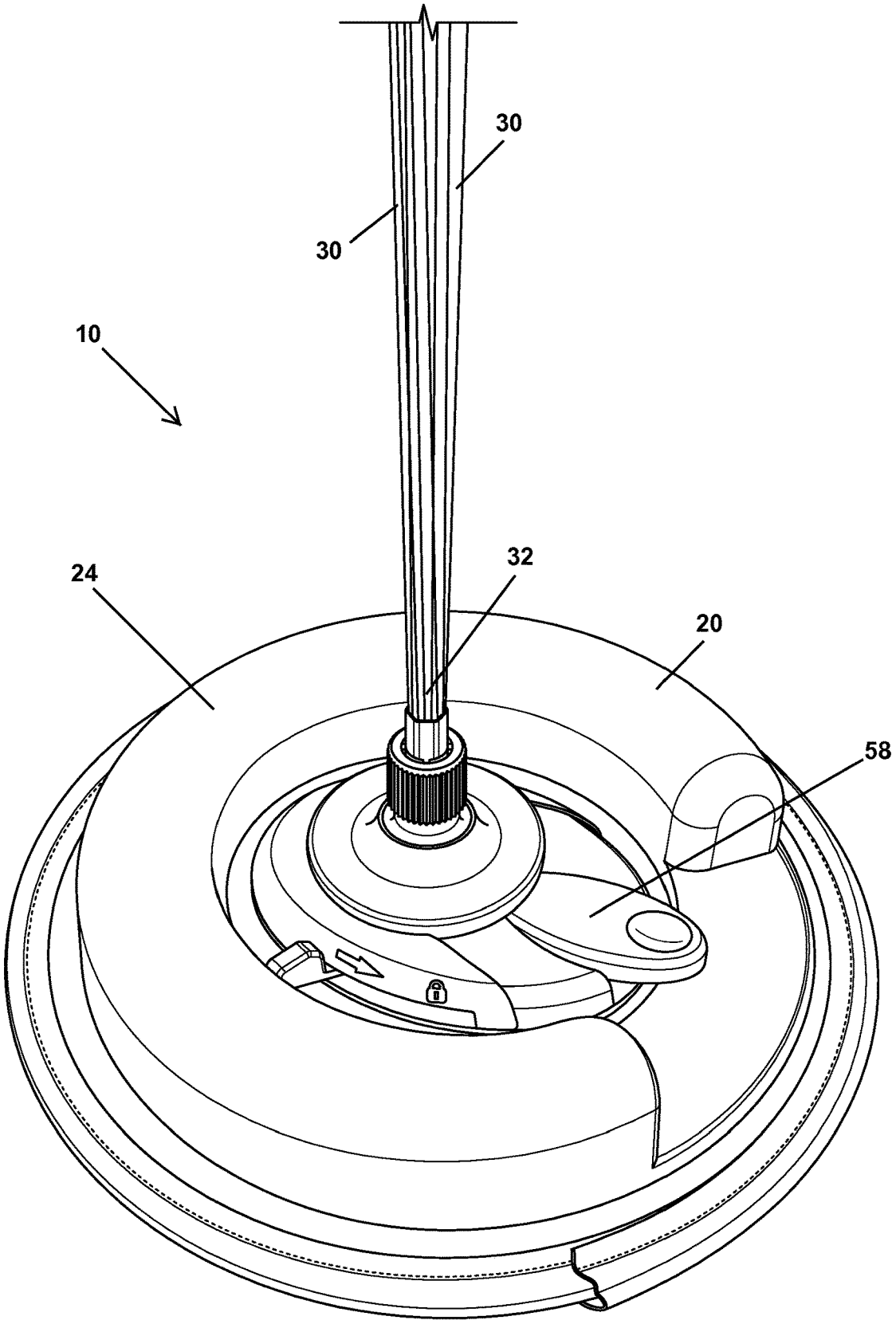
FIG. 2 is an enlarged perspective view of a lower portion of the basketball training device.
Figure 3:
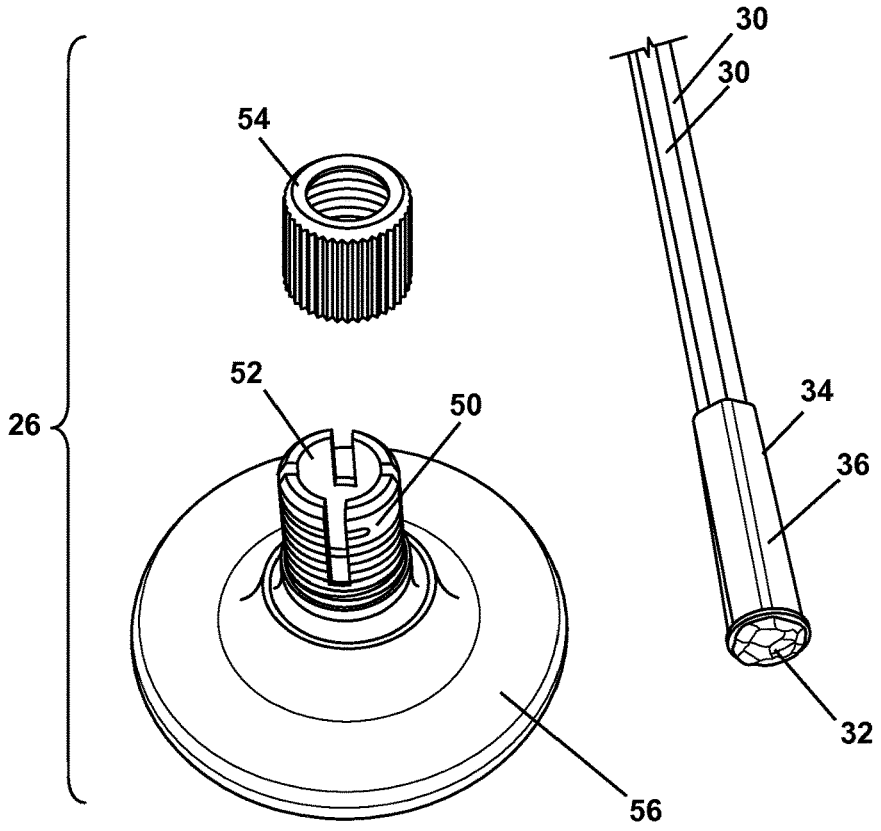
FIG. 3 is an exploded view of the proximal ends of the flexible members and a holder which holds the flexible members to the rest of the base of the basketball training device.
Figure 4:
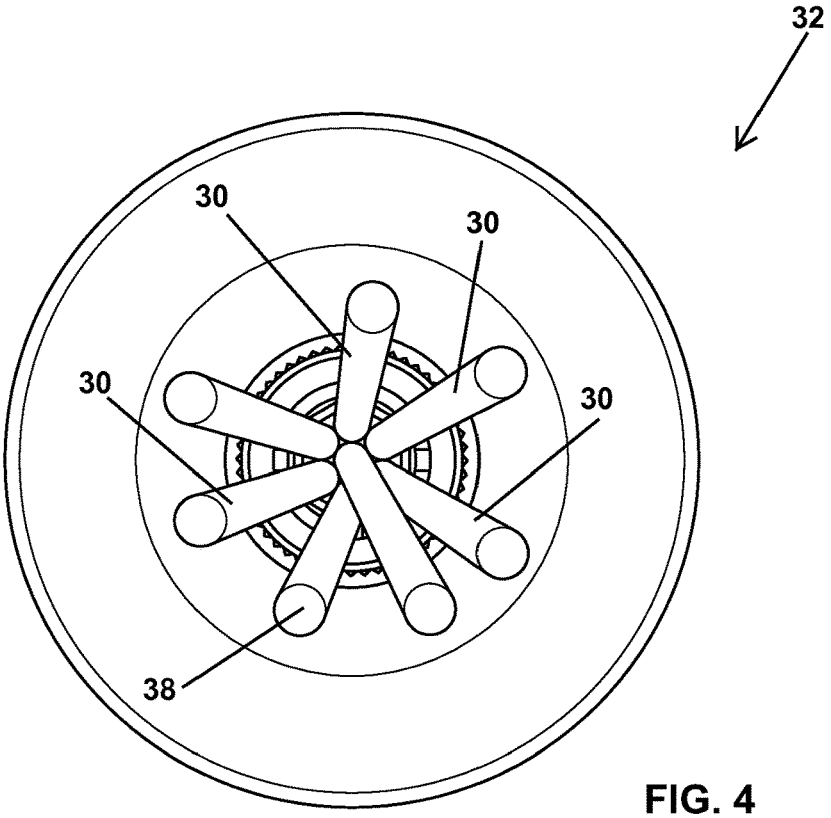
FIG. 4 is a top view of the basketball training device.
Figure 5:
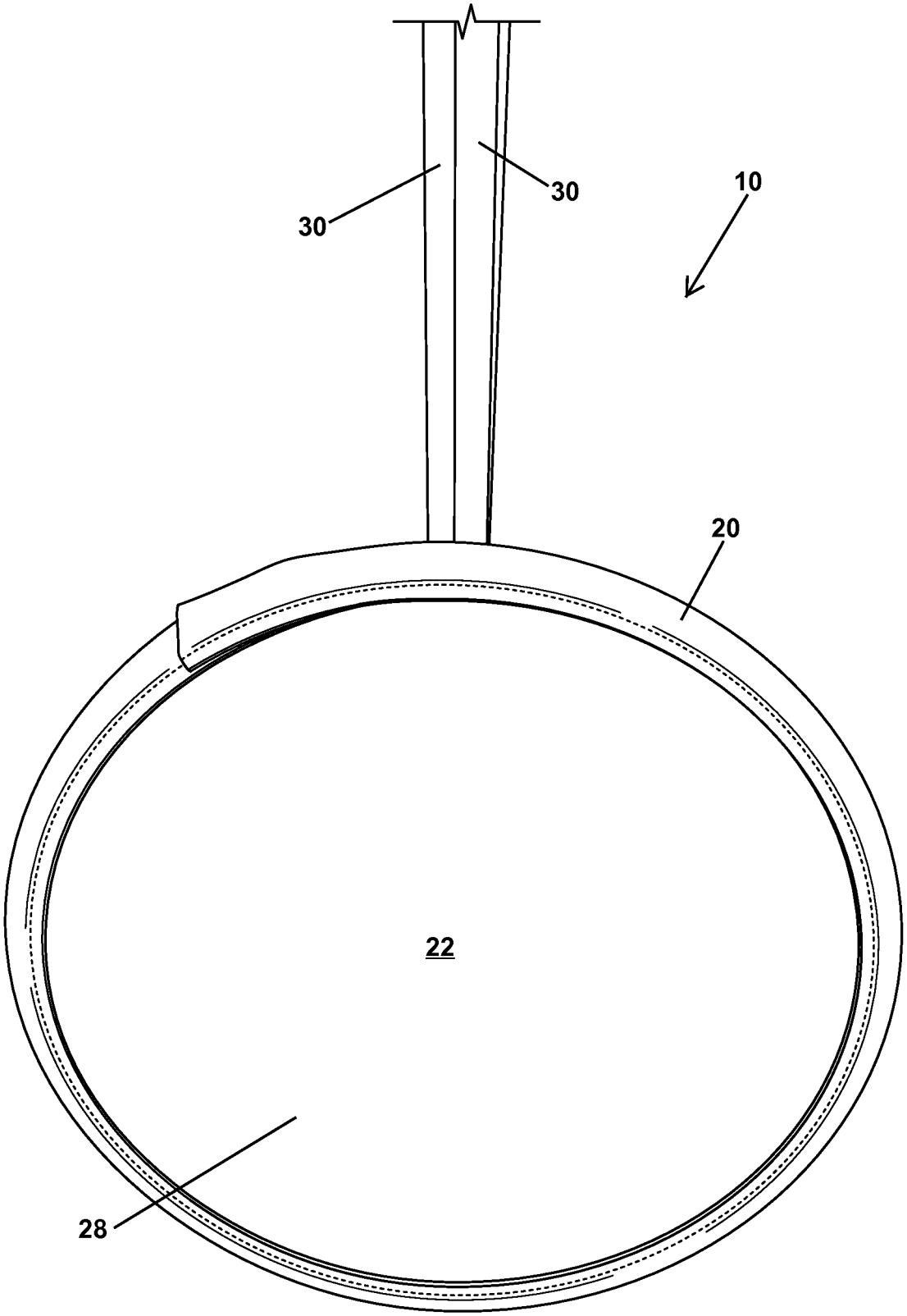
FIG. 5 is a bottom perspective view of the lower portion of the basketball training device.

A basketball training device 10 is described herein that trains basketball players to sweep the ball low when attacking off the dribble or to protect the ball if they are being defended by a player with high hands Referring now to FIGS. 1-6, training device 10 in one embodiment includes a base 20 with a friction promoting surface 22 to engage the gym floor. Preferably, device 10 will not move upon normal impact during use. The device 10 includes upright flexible members, bristles or fibers 30 extending upwardly from base 20. The fibers 30 are able to bend upon contact with a ball and regain their original position. The device 10 remains stationary on the ground after every repetition. Device 10 is also portable. A player can put it in their bag and transport it to the gym.

Basketball players often do not understand how low they have to go to sweep the ball when attacking the opposing team off the dribble. The device 10 helps to solve this problem.

Device 10 gives players a tangible goal to attack with the basketball so they properly sweep the ball. If a conventional gym cone is used instead of the disclosed training device 10, a player will strike the cone with the basketball and the cone will fly across the gym. A chair as an alternative is bulky and dangerous for players to work around. If another player or the coach guards the player with the basketball, the player may not understand when good technique is followed or achieved. With a cone, a player or coach has to chase the cone after every repetition to repeat the process. Chairs are not easily portable. Players could be injured by contacting the chair during practice.

Device 10 includes base 20 which has sufficient friction and weight to be maintained in a relatively stationary position during use as the basketball player knocks the fibers 30 with their hand while holding the ball with two hands and/or the basketball itself. In one embodiment, base 20 is similar to a GARMIN type device used with automobile GPS units to hold the unit on the dashboard of an automobile for viewing by the driver. A fiber holder 26 releaseably mounts to base body 24. Holder 26 holds the fibers upright. Holder 26 includes a threaded and slotted upper end 50 and an opening 52 for receiving proximal ends 32 of each of the fibers 30. A threaded nut 54 threadably engages threaded end 50 of holder 26 for tightening down against the fibers. Also, fibers 30 are held together at the proximal ends 32 with adhesive, or heat fusion, in additional implementations. A heat shrink sleeve or tubing 36 can also be applied to facilitate holding of the proximal ends 32 together in a bundle 34. A bottom portion 56 of holder 26 releasably mounts to base body 24 with a mounting arrangement 58, such as the above-mentioned GARMIN type device with holds GPS units for an automobile. Other holders are possible for holding one or more flexible members in an upright manner for use as a sweep drill device.

Each of the fibers 30 is bendable along the fiber length back and forth so that distal ends 38 move relative to proximal ends 32 and base 20. Once contacted by the player, the fibers 30 will bend several times back and forth until arriving again at the upright vertical position. As shown in the figures, distal ends 38 of the fibers 30 will disperse slightly in the at rest position, yet all of the fibers are generally perpendicular to a lower surface 22 of the base 20. In one implementation, a bundle of eight (8) 0.25 inch (approximately 6.4 millimeters) in diameter fibers each having a length of about 13.25 inches (approximately 33.7 centimeters) can be used, wherein each fiber is 0.08 inches (approximately 2.0 millimeters) in diameter. Another implementation utilizes each fiber having a bundle 5 millimeters (approximately 0.2 inches) in diameter for seven (7) such fibers, each fiber about 2 millimeters (approximately 0.08 inches) in diameter and each fiber being about 35 centimeters (approximately 13.8 inches) long.

Figure 6:
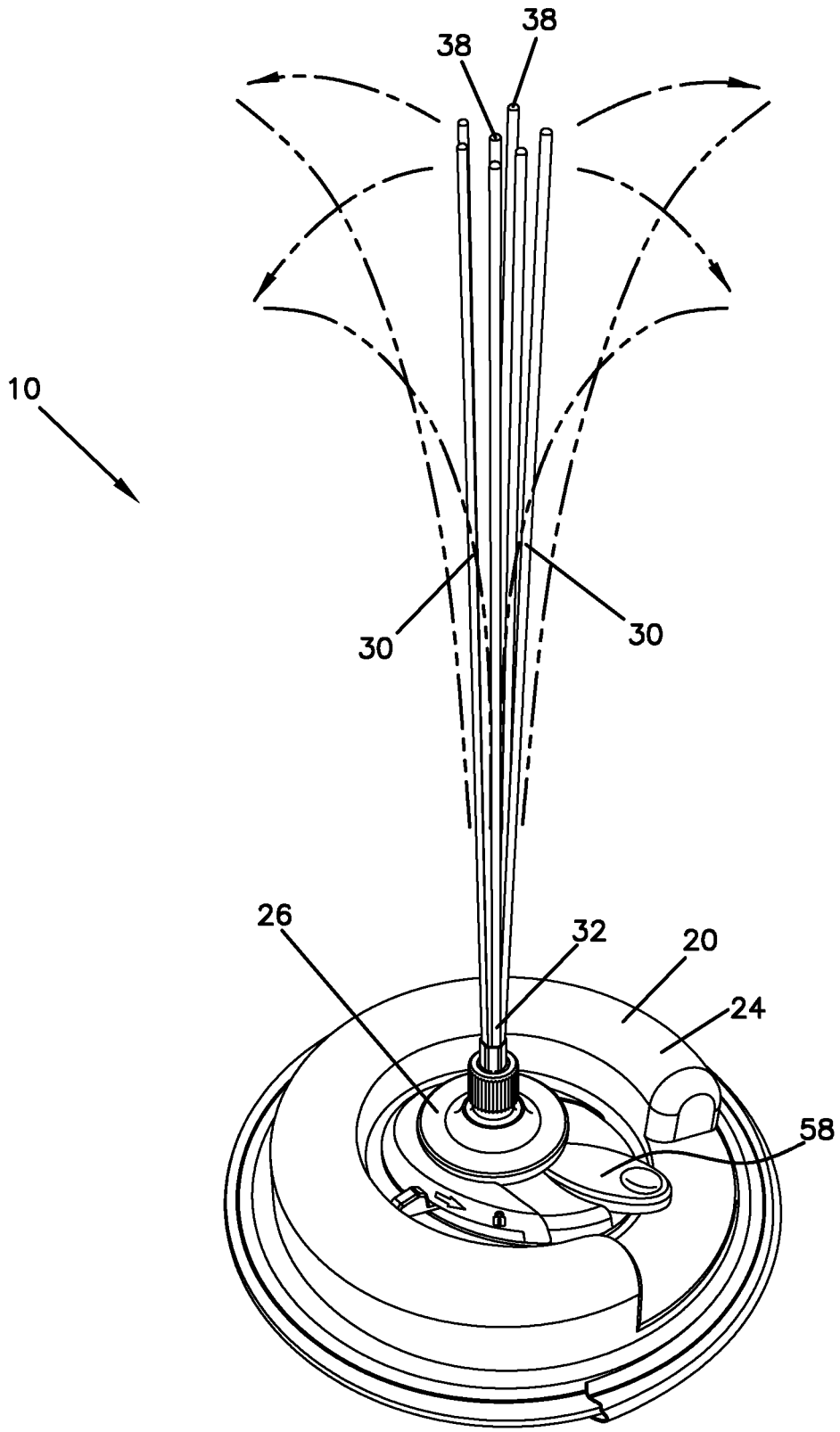
FIG. 6 shows the basketball training device during use.

Preferably, a plurality of the fibers is provided and each fiber is made from a plastic material which allows for bending of the fibers during use without damage. Preferably, the fibers are at least 15 centimeters long. Preferably, the fibers are between 15 to 55 centimeters long, and more preferably between 25 and 45 centimeters long. One example implementation is about 35 centimeters long. As can be seen from review of FIGS. 1 and 6, the fibers 30 are longer than a height of the base 20. FIGS. 1 and 6 show that the fibers 30 are at least 4 times the height of the base 20.

Preferably the fibers are between 1 to 4 millimeters (approximately 0.04 to 0.16 inches) in diameter, more preferably about 2 millimeters (approximately 0.08 inches) in diameter.

The plurality of fibers is arranged in a bundle at proximal ends 32 wherein the range in diameter of the bundle is between about 2 millimeters (approximately 0.08 inches) for one (1) fiber up to twenty one (21) fibers having a bundle diameter of about 15 millimeters (approximately 0.6 inches). In one implementation, seven (7) fibers can be bundled together at about 5 millimeters (approximately 0.2 inches) in diameter. Other numbers of fibers can be used, such as three (3), four (4), five (5), six (6), or more.

The base 20 is preferably provided with a friction promoting lower surface 22 for engaging the ground, such as the gym floor surface. A diameter of between about 7 centimeters to 30 centimeters is useful. In one implementation, the diameter is provided at about 17 centimeters. Therefore, when the base 20 has a diameter of 7 centimeters, and the fibers have a bundle diameter of 15 millimeters (as described above), the diameter of the base 20 is at least 4 times the bundle diameter. When the base 20 has a diameter of 17 centimeters, and the fibers have a bundle diameter of 5 millimeters (as described above), the diameter of the base 20 is at least 34 times the bundle diameter.

The base 20 is preferably provided with a friction promoting lower surface 22 for engaging the ground, such as the gym floor surface. A diameter of between about 7 centimeters to 30 centimeters is useful. In one implementation, the diameter is provided at about 17 centimeters.

The above implementations are just several examples of devices 10. Other dimensions and numbers of fibers are possible in accordance with the principles of the invention.

As constructed for use in a basketball training device, a middle area of the elongated fibers 30 is the aiming point for the player during use. Preferably, such an area is below the player's waist and more preferably around the knee area or lower. The player will hold the basketball with two hands and sweep it towards and across the fibers. After sweeping the ball across the fibers, the player has simulated moving the basketball beneath the hands of a defensive player. The friction mount ensures the device 10 stays in one place on the gym floor. Even if the friction mount becomes dirty or dusty, the weight of the friction mount preferably keeps it in place.

In one construction of device 10, a friction promoting material is attached to a small, relatively heavy, base body 24 at a lower surface 22, to prevent sliding and tipping of device 10. Fibers 30 made of polypropylene with a circular cross-section can be bound together at proximal ends 32 in a bundle 34, with fusion and a heat shrink tubing 36. The bound fibers can then be mounted to the base 20 at bundle 34 with holder 26.

In one example, the fibers 30 extend from a closely grouped proximal end 32 to a slightly dispersed group of fibers 30 at distal ends 38. The dispersion is noted as dispersion 60 in the drawings. In general the dispersion amount is relatively small compared to the length of fibers 30. Fibers 30 generally are all vertical in the at rest position.

Being able to detach fibers 30 and the holder 26 from the base body 24 can make storing and transporting the device easier. Replacement of fibers 30 is also an option. The base 20 and/or the fibers 30 can be colored as desired to assist with training drills.

In use, a basketball player would position device 10 on a basketball court floor. In one example, he or she can place the device 10-20 feet (approximately 3.0 to 6.1 meters) from the basket at any angle from the basket. The player would then stand with the device 10 centered slightly in front of the player. Next, the player would place the ball on their hip, move the ball from their hip down to the fibers 30, brush the fibers 30 as they move the ball towards their other hip in a U-shaped path. The player makes contact with the fibers with the ball, their hand, and/or their arm. The player can do this while remaining stationary to work on sweeping the ball from hip to hip in a U-shape. The sweeping move can be repeated as many times as desired. The player can also sweep the ball from hip to hip and circle toward the basket with a dribble after sweeping the ball the proper depth. By having the fibers 30 in front of the player, they have a tangible target to aim for. Device 10 can provide feedback to the player and the coach in that the moving fibers 30 can be seen, and/or heard, and/or felt by the players and/or coaches. Device 10 eliminates the guesswork of how low the ball must be swept to effectively protect the basketball and attack the basket off the dribble in the game of basketball. During use, the fibers can be pushed, brushed, struck or moved to a bent position. After movement, the fibers will bend back and forth until returning to the upright position.

Device 10 stays in the desired location during use, so time is save by not having to rest the device each time. Also, the device is sized specially for the sweep drill. Further, there is not a hard or sharp surface for the player to worry about as in the case of a chair. The length of fibers 30 can be changed if desired, such as for special uses with very small children, or very tall players, like college of professional basketball players.

Device 10 could be used to replace cones in many sports using a gym floor. Device 10 is able to be touched without falling over or sliding across the floor like cones often do.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A basketball training device comprising:

(a) a plurality of elongated flexible members comprising plastic, (i) wherein each of the flexible members generally maintains a linear shape in an at rest position;

(b) a base with a ground engaging lower surface, and an upper mounting device for holding the plurality of flexible members at the respective proximal ends of the flexible members in a parallel manner, (i) the ground engaging lower surface having a friction promoting surface to engage the ground;

(ii) the base having a height measured from the ground;

(c) wherein the upper mounting device forms a holder for holding the plurality of flexible members at the respective proximal ends of the flexible members;

(d) wherein the holder is removable from a remainder of the base;

(e) wherein each of the flexible members extends generally perpendicularly to a center portion of the lower surface;

(f) wherein the distal ends of each of the flexible members are free to move independently and bend relative to the proximal ends;

(g) wherein the proximal ends of each of the flexible members are connected in a bundle;

(h) wherein each of the flexible members extends from the base, (i) wherein the portions of each of the flexible members between the base and the distal ends define a circular cross-section;

(i) wherein the distal end of each of the flexible members is exposed and each flexible member is free to move and bend when the flexible members are moved by a basketball player or a basketball held by the basketball player, wherein the flexible members return to the at rest positions by themselves after the flexible members are moved by the basketball player or the basketball held by the basketball player;

(j) wherein each of the flexible members is between 1 to 4 millimeters in diameter;

(k) wherein each of the flexible members is between 15 and 55 centimeters long and longer than the base height;

(l) wherein the plurality of flexible members includes at least three (3) flexible members;

(m) wherein the plurality of flexible members defines a maximum height of the basketball training device;

(n) wherein the bundle of the proximal ends of the flexible members is the only element extending upwardly from the base;

(o) wherein the ground engaging lower surface of the base defines an outer maximum perimeter, wherein each of the distal ends is within an area defined by the outer maximum perimeter extending upwardly from the base in the at rest positions of the flexible members;

(p) wherein the plurality of flexible members defines an exposed middle area between the distal ends and the proximal ends for being contacted by the basketball player or the basketball held by the basketball player.

2. The basketball training device of claim 1, wherein the flexible members are between 25 and 45 centimeters long.

3. The basketball training device of claim 2, wherein the flexible members are about 35 centimeters long.

4. The basketball training device of claim 1, wherein the flexible members are about 2 millimeters in diameter.

5. The basketball training device of claim 1, wherein the at least three flexible members includes at least seven (7) flexible members.

6. The basketball training device of claim 5, wherein the at least seven flexible members define a bundle having a diameter of about 5 millimeters, wherein the proximal ends of the at least seven flexible members are fused together and further held by a heat shrink tubing.

* * * * *